United States Patent [19]

Haddad

[11] 4,330,065

[45] May 18, 1982

[54] PORTABLE WATER SKI RACK

[76] Inventor: William G. Haddad, #47 Hitching Post, Rolling Hills Estates, Calif. 90274

[21] Appl. No.: 170,853

[22] Filed: Jul. 21, 1980

[51] Int. Cl.[3] ..... A47F 7/00

[52] U.S. Cl. ..... 211/60 SK; 224/917; 280/814

[58] Field of Search ..... 211/60 SK, 64, 60 A, 211/170, 195; 280/814, 815; 224/913, 922, 917, 42.08

[56] References Cited

U.S. PATENT DOCUMENTS

| | | | |
|---|---|---|---|
| 3,155,238 | 11/1964 | Bennett | 211/60 SK |
| 3,288,304 | 11/1966 | Graves | 211/64 |
| 3,338,422 | 8/1967 | Hickok | 211/60 SK |
| 4,056,220 | 11/1977 | Trimble | 211/60 SK X |
| 4,232,806 | 11/1980 | Shald | 211/60 SK X |
| 4,269,337 | 5/1981 | Sobofka | 224/917 X |

*Primary Examiner*—Ramon S. Britts
*Assistant Examiner*—Robert W. Gibson, Jr.
*Attorney, Agent, or Firm*—Joseph Shulsinger

[57] ABSTRACT

A portable rack for storing and transporting water skis, capable of being mounted over the engine of a water ski boat, or carried by hand with the water skis in place.

6 Claims, 3 Drawing Figures

PORTABLE WATER SKI RACK

BACKGROUND OF THE INVENTION

1. Field of the Invention

This invention relates to racks and carrying devices for sports equipment and more particularly to portable folding racks for storing and transporting water skis.

2. Description of the Prior Art

Water skiing has become one of the most popular participant sports in the United States. In response to the increasing demand for equipment, new styles and models of boats and skis are constantly developed. It is not uncommon for enthusiasts of the sport to spend tens of thousands of dollars on specially designed water ski boats and hundreds of dollars each on many pairs of specially designed water skis. Most water ski boats are used on week-end and vacations and are frequently removed from the water and transported on trailers.

Most water ski boats have no provisions for storing the skis. Therefore, the skis are merely loosely placed in the boat where they are in the way and subject to damage when not in use. When the boat is unattended or being transported by trailer the skis must be individually removed and stored someplace else. Frequently this means loosely placed in the back of a pick-up truck where they are again in the way and subject to damage.

The instant invention provides a portable rack in which the water skis may be securely stored and transported without damage to the skis. On most boats this rack fits over the engine where the skis are readily accessible and out of the way. When it is desirable to remove the skis from the boat, the entire rackful of skis can be lifted and carried to the beach where it may be placed in a truck or anywhere desired. During the transportation and storage the skis are securely retained in the rack.

No known prior art exists performing all these functions. There are some fixed installation racks for storing skis on boats or in trucks. These are usually custom made. There are custom shipping and storage containers for individual skis or pairs of skis, but these do not provide ready accessibility to the skis and are not themselves suited to intermittent mounting on boats.

SUMMARY OF THE INVENTION

The present invention is basically a pair of slotted A-frames. These A-frames are interconnected by means of three long members usually shaped as rods or bars. One of these long members is connected between the two A-frames near their apexes. Each of the other tow long members is connected between corresponding legs of the two A-frames, near the lower end of the leg.

Each A-frame leg is formed containing a series of parallel slots proceeding from the outboard edge of the leg at a slight downward angle toward the center of the A-frame. The distance between the corresponding legs of the A-frames, and the size and shape of the slots, are such that a water ski may be placed in a slot of the foward A-frame and a corresponding slot in the rear A-frame, and stored there. A thin buffer strip of resilient material is bonded to the entire edge of each A-frame leg, including the slots, to protect people, the skis, and the boat against damage.

Connected to each of the lower long members, and spaced apart from each other, are a pair of flexible tension members. These tension members may be elastic, or adjustable in length, or both. A hook or similar device is attached to each tension member at the end away from the long member. In use, the invention is placed over the boat engine with each A-frame straddling the raised fore and aft portion of the engine cover. The hooked ends of the tension members are attached to the sides of the engine or to the boat frame, effectively strapping the invention to the boat.

Connected to the upper long member are two or more retainer straps which may be elastic, or adjustable in length, or both. The free end of each retainer strap contains a hook or similar device which may engage one of the lower long members. When skis are in the rack, at least one of the retainer straps may be connected under tension between the upper and lower long members on the side containing the skis and outboard of the skis. This holds the skis in place. When it is desired to remove one or more of the skis, the retainer strap is disengaged from the lower long member and the ski is easily lifted out.

When it is time to remove the skis from the boat, when the boat is to be transported by trailer for example, the skis can be placed in the rack and secured by means of the retainer straps. The tension members can then be unhooked from the engine or boat frame and the entire rack lifted off the boat with the skis in place. The upper long member serves as a handle for this purpose. The two legs of each A-frame are connected to the upper long member in a manner permitting the legs to pivot together. Thus when the rack with skis installed is lifted by means of the upper long member, the two halves of the rack pivot together forming a more compact package which is easier to handle.

The entire rack with skis can then be transported or stored as a unit in a compact package which is out of the way and protects the skis. When it is time to waterski again, the entire package can be easily carried to the boat and reinstalled in a short time, ready for use.

DETAILED DESCRIPTION OF THE INVENTION

Figure 1:
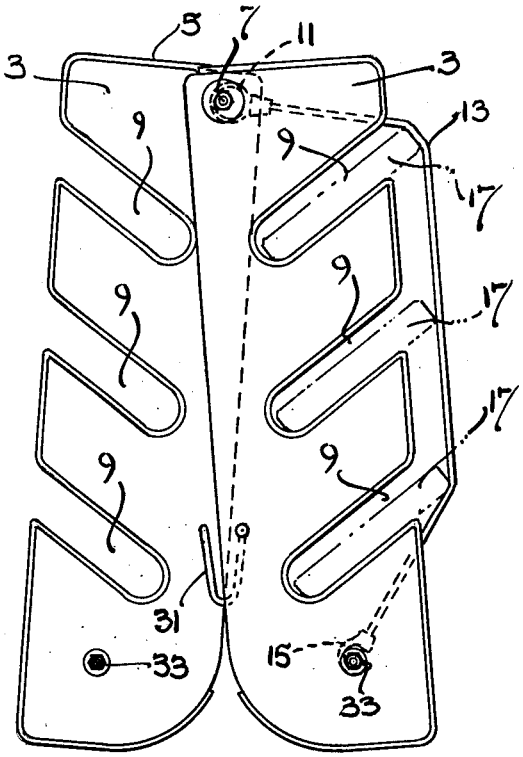
FIG. 1 depicts an end view of the invention in the folded configuration showing water skis typically on one side.

A preferred embodiment of the invention consists of two halves pivotally connected together near the top inboard corners of each half by means of a top horizontal member (7). Each half is made from two end pieces (3) between which a lower horizontal member (33) is fixedly mounted near the lower end of each end piece (3). A series of parallel slots (9) are formed in each end piece (3), from the outboard edge thereof sloping slightly downward and towards the inboard edge of the end piece. A resilient buffer strip (5) is fixedly mounted along the edge of each end piece (3) including the edges of each slot (9). A flexible keeper (31) is connected between the pair of adjacent end pieces (3) at each end of the invention near the lower inboard portion of each end piece. At least one fastening device (11) is mounted on the top horizontal member at a fixed distance between the fore and aft pair of end pieces. Attached to either side of the invention, depending from each fastening device (11), is an elastic retainer strap (13). A retainer strap hook (15) is fixedly connected to the end of the elastic retainer strap (13) distal the fastening device (11). At least two tie-down fasteners (21) are fixedly mounted on each lower horizontal member (33) spaced at predetermined distances from the end pieces (3). Depending from each tie-down fastener (21) is a flexible tie-down (23) which is either elastic or adjustable in length. A tie-down hook (25) is fixedly attached to the end of each flexible tie-down (23) distal the tie-down fastener (21).

Figure 2:
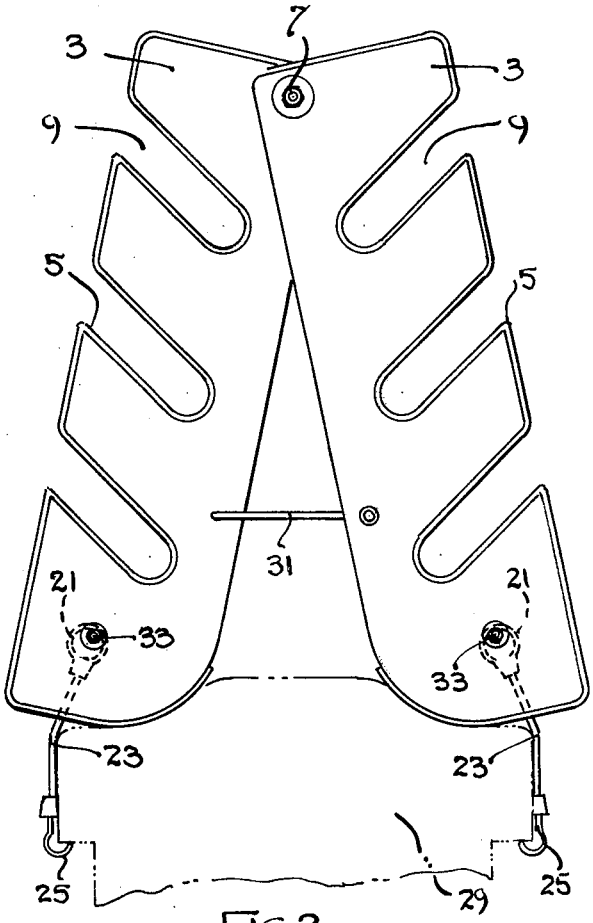
FIG. 2 depicts an end view of the invention in the unfolded configuration typically mounted on top of a boat engine.
Figure 3:
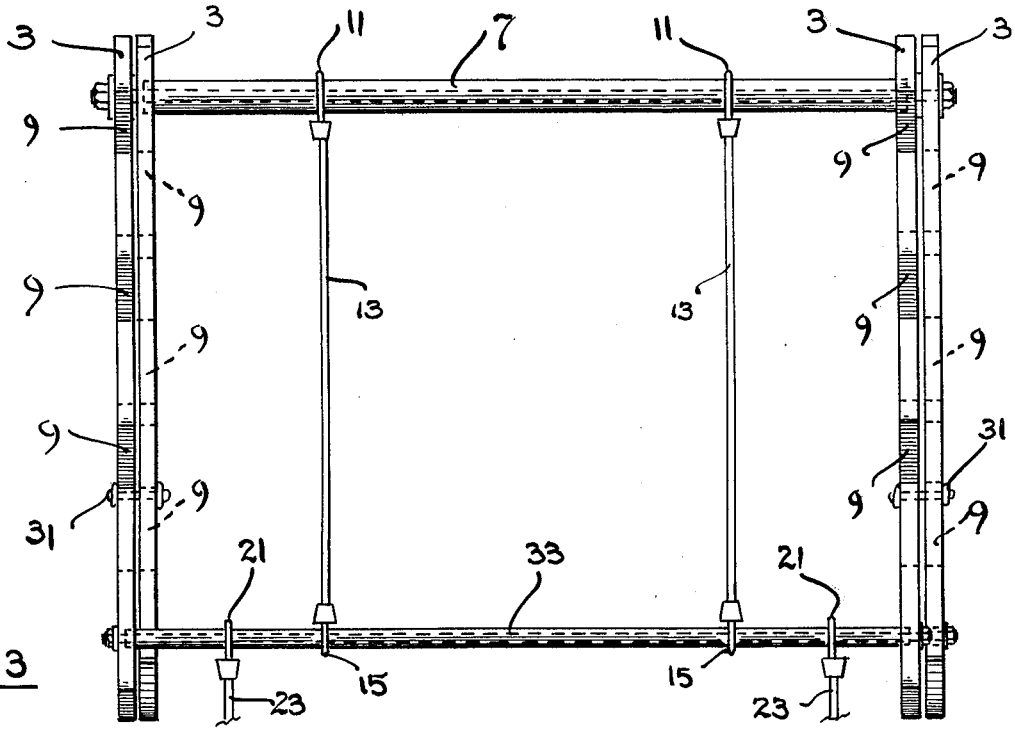
FIG. 3 depicts a side view of the invention.

As shown in FIG. 2, the invention may be mounted in the opened configuration on top of the boat engine cover (not part of the invention) shown in phantom at (29). The lower ends of the end pieces (3) are spread apart as far as the keeper (31) will permit. The tie-down hooks (25) are fastened to the boat engine or some other suitable point on the boat such that a tension is maintained in each flexible tie-down (23). Thus the invention is held firmly in place on top of the boat engine. Water skis, as shown in phantom at (17), may be placed in any one or more fore and aft pairs of slots (9). The buffer strip (5) protects the skis from scarring in addition to inhibiting fore and aft slippage. When the desired number of skis are placed on one side of the invention, the elastic retainer strap (13) may be placed around and outboard of the skis and the retainer strap hook (15) hooked around the lower horizontal member (33). The pressure from the elastic retainer strap (13) presses the water skis against the buffer strip (5) holding the skis in place.

When it is desired to remove the skis and rack from the boat it is only necessary to disconnect the tie-down hooks (25) and the rack may then be lifted vertically by applying an upward force to the top horizontal member (7). Without removing the skis the rack can then be carried by the top horizontal member (7) wherever desired. As the rack is lifted, the two halves tend to pivot together as shown in FIG. 1, making the outside envelope smaller and more compact.

Those skilled in the art will recognize many other useful embodiments that may be achieved through variations in the form of the members and fabrication and assembly techniques, all of which come within the scope of the present invention.

I claim:

1. A portable rack comprising:

four slotted end pieces, three long members, means pivotally attaching two said slotted end pieces to each end of one said long member, near the upper inboard corner of each said slotted end piece, means fixedly attaching each other said long member, parallel to said one long member, between ends of two corresponding said slotted end pieces, at least two retainer straps, means fixedly attaching one end of each said retainer strap to said one long member, hook means fixedly attached to the end of each said retainer strap distal said one long member, at least two flexible tie-down members, means fixedly attaching one end of each tie-down member to one of said other long members such that at least one said tie-down member is attached to each said long member, hook means fixedly attached to the end of each said tie-down member distal said other long member, resilient buffering means fixedly attached to all edges of each said slotted end piece, and two flexible or hinged members, fastened, one between the two said slotted end pieces at one end of said rack, and the other between the two said slotted end pieces at the other end of said rack, near the lower portion of said slotted end pieces, in a manner to limit the relative pivotal movement of said slotted end pieces.

2. The portable rack of claim 1 wherein each slotted end piece comprises a flat, generally rectangularly shaped member having a series of parallel slots formed therein, each slot opening on a first or outboard long edge of said end piece and sloping slightly downward and towards the opposite or inboard edge of said end piece.

3. The portable rack of claim 1 wherein each retainer strap comprises a length of elastic material.

4. The portable rack of claim 1 wherein each retainer strap comprises a strip of flexible material and a buckle so arranged that the length of said retainer strap may be adjusted as desired.

5. The portable rack of claim 1 wherein each said tie-down member comprises a length of elastic material.

6. The portable rack of claim 1 wherein each said tie-down member comprises a strip of flexible material and a buckle so arranged that the length of said tie-down member may be adjusted as desired.

* * * * *